US008152278B2

(12) United States Patent
Komuro

(10) Patent No.: US 8,152,278 B2
(45) Date of Patent: Apr. 10, 2012

(54) LIQUID JET HEAD CHIP AND MANUFACTURING METHOD THEREFOR

(75) Inventor: Hirokazu Komuro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 753 days.

(21) Appl. No.: 11/955,772

(22) Filed: Dec. 13, 2007

(65) Prior Publication Data

US 2008/0143791 A1 Jun. 19, 2008

(30) Foreign Application Priority Data

Dec. 14, 2006 (JP) ..... 2006-337030
Nov. 6, 2007 (JP) ..... 2007-288550

(51) Int. Cl.
*B41J 2/05* (2006.01)

(52) U.S. Cl. ..... 347/58; 347/50; 347/59; 347/65

(58) Field of Classification Search ..... 347/58, 347/50, 59, 63, 64, 65
See application file for complete search history.

(56) References Cited

U.S. PATENT DOCUMENTS

| | | | | |
|---|---|---|---|---|
| 5,458,254 | A | 10/1995 | Miyagawa et al. | |
| 5,478,606 | A | 12/1995 | Ohkuma et al. | |
| 5,945,260 | A | 8/1999 | Miyagawa et al. | |
| 6,508,536 | B1 * | 1/2003 | Beerling et al. | 347/42 |
| 6,520,624 | B1 * | 2/2003 | Horvath et al. | 347/42 |
| 6,543,880 | B1 * | 4/2003 | Akhavain et al. | 347/42 |

FOREIGN PATENT DOCUMENTS

| | | | |
|---|---|---|---|
| JP | 5-330066 | A | 12/1993 |
| JP | 6-286149 | A | 10/1994 |
| JP | 8-25272 | A | 1/1996 |
| JP | 08-25272 | B | 3/1996 |
| JP | 10-13849 | A | 1/1998 |
| JP | 10-138497 | A | 5/1998 |
| JP | 2006-321222 | A | 11/2006 |
| WO | W02006/112526 | A1 | 10/2006 |

* cited by examiner

*Primary Examiner* — Matthew Luu
*Assistant Examiner* — Henok Legesse
(74) *Attorney, Agent, or Firm* — Fitzpatrick, Cella, Harper & Scinto

(57) ABSTRACT

A liquid ejection head includes a substrate including, at a surface thereof, an ejection energy generating means for generating ejection energy for ejecting liquid, a flow path forming member provided with an ejection outlet, the substrate further including a liquid supply opening, penetrating therethrough, for supplying the liquid to be ejected by the ejection energy to a flow path of the flow path forming member; a reinforcing member connected to a back side of the substrate; a first penetrating electrode, penetrating the substrate from a front side to the back side thereof, for supplying electric power to the ejection energy generating means; and a second penetrating electrode penetrating the reinforcing member from a front side to a back side thereof, the second penetrating electrode being electrically connected to the first penetrating electrode.

4 Claims, 8 Drawing Sheets

LIQUID JET HEAD CHIP AND MANUFACTURING METHOD THEREFOR

FIELD OF THE INVENTION AND RELATED ART

The present invention relates to a liquid jet head chip which jets liquid from its liquid ejection openings, and a manufacturing method therefor.

There are various liquid jet head chips which jet liquid from their liquid ejection openings. Among these liquid jet head chips, an ink jet head chip has been most widely known.

There has been known an ink jet head chip manufacturing method, such as the one recorded in Japanese Laid-open Patent Application H10-13849, which forms the common ink delivery channel of an ink jet head chip by anisotropic etching.

There has also been known another ink jet head chip manufacturing method, which is recorded in Japanese Laid-open Patent Applications H05-330066 and H06-286149. This method has been known as an ink jet head chip manufacturing method for very precisely forming the ink passages of an ink jet head chip, at a high density. There is also the ink jet head chip manufacturing method recorded in Japanese Laid-open Patent Application H10-138497. According to this application, the common ink delivery channels of an ink jet head chip is formed with a combination of different types of anisotropic etching.

In the case of an ink jet head chip, in accordance with the prior art, which jets ink in the direction perpendicular to the heat generating surface of a heat generating resistor, the electrodes of the ink jet head chip, which are for supplying heat generating resistors on the substrate of the ink jet head chip, with electricity, are connected to an external wiring plate, on the surface of the substrate of the ink jet head chip, which has the ink ejection openings. That is, the electrical joint is on the surface of the substrate of the ink jet head chip, which has the ink ejection openings. Placing the electrical joint on the surface of the substrate of an ink jet head chip unavoidably creates bumps on the surface, making it necessary to increase the distance between the surface having the ink ejection openings and the sheet of recording paper, as recorded in Japanese Patent Application Publication H08-25272. This has been problematic in that when this type of ink jet head chip is used for recording, its electrical joint is in the space (gap) between the ink ejection openings and the sheet of paper (recording medium), affecting thereby an ink jet recording apparatus in recording performance.

Thus, it has been thought of making electrical connection between the abovementioned electrodes and external wiring plate, on the opposite surface of the substrate from the surface having the ink ejection openings, in order to prevent the formation of the bumps on the surface having the ink ejection openings. One of the embodiments of this thought is recorded in Japanese Laid-open Patent Application 2006-321222. According to this application, the ink jet head chip is provided with electrodes (which hereafter will be referred to as through electrode) which extend through the substrate of the ink jet head chip from the surface having the ink ejection openings to the opposite surface, and the electrical connection between the abovementioned electrodes of the ink jet head chip and the external wiring plate is made on the surface opposite from the surface having the ink ejection openings.

FIG. 6 shows an example of an ink jet head chip, which employs through electrodes. FIG. 6A is a schematic plan view of the ink jet head chip employing the through electrodes. The through electrodes are not shown in FIG. 6A. FIG. 6B is a schematic sectional view of the ink jet head chip, at a plane which coincides with Line X3-Y3 in FIG. 6A.

The substrate 301 of the ink jet head chip has a common ink delivery channel 302, which is in the form of an elongated trapezoid, the lengthwise direction of which is parallel to the row of heat generating resistors, which corresponds to the recording width of the ink jet head chip. In order for an ink jet recording apparatus to be increased in recording speed, it needs to be increased in the width of one of the multiple passes which must be made across a sheet of recording medium by the ink jet head chip of the ink jet recording apparatus to complete a single copy of an image. However, increasing an ink jet head chip in the recording width, that is, one of the abovementioned passes, requires lengthening the row of ink ejection openings, which in turns requires lengthening the common ink delivery channel 302. The longer the common ink delivery channel 302, the greater the deformation of the center portion of the common ink delivery channel 302. Further, the greater the deformation, the more likely it is for the ink passage formation plate, or the like, to separate from the substrate 301, and/or crack. Thus, in the case of an ink jet head chip in accordance with the prior art, the ink passage formation plate on the substrate 301 sometimes separated from the substrate 301, and/or the substrate 301 itself sometimes cracked.

SUMMARY OF THE INVENTION

The primary object of the present invention is to provide a liquid jet head chip which employs through electrodes, but, does suffer from the problem that the center portion of its substrate deforms, and also, to provide a method for manufacturing the liquid jet head.

According to an aspect of the present invention, there is provided a liquid ejection head comprising a substrate including, at a surface thereof, an ejection energy generating means for generating ejection energy for ejecting liquid, a flow path forming member provided with an ejection outlet, said substrate further including a liquid supply opening, penetrating therethrough, for supplying the liquid to be ejected by the ejection energy to a flow path of said flow path forming member; a reinforcing member connected to a back side of said substrate; a first penetrating electrode, penetrating said substrate from a front side to the back side thereof, for supplying electric power to said ejection energy generating means; and a second penetrating electrode penetrating said reinforcing member from a front side to a back side thereof, said second penetrating electrode being electrically connected to said first penetrating electrode.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

The liquid jet head chips in the following embodiments of the present invention are ink jet head chips. An ink jet head is one of the various forms of liquid jet head, and therefore, an ink jet head chip is one of the variations forms of liquid jet head chip. Similarly, the ink, ink ejection opening, common ink delivery channel, and ink delivering member of the ink jet head chip, are equivalent to the liquid, liquid ejection opening, common liquid delivery channel, and liquid delivering member of a liquid jet head chip, respectively. A liquid jet head in accordance with the present invention can be used as a device for ejecting liquid fuel, cosmetic liquid, medicinal liquid, etc.

Figure 1A:
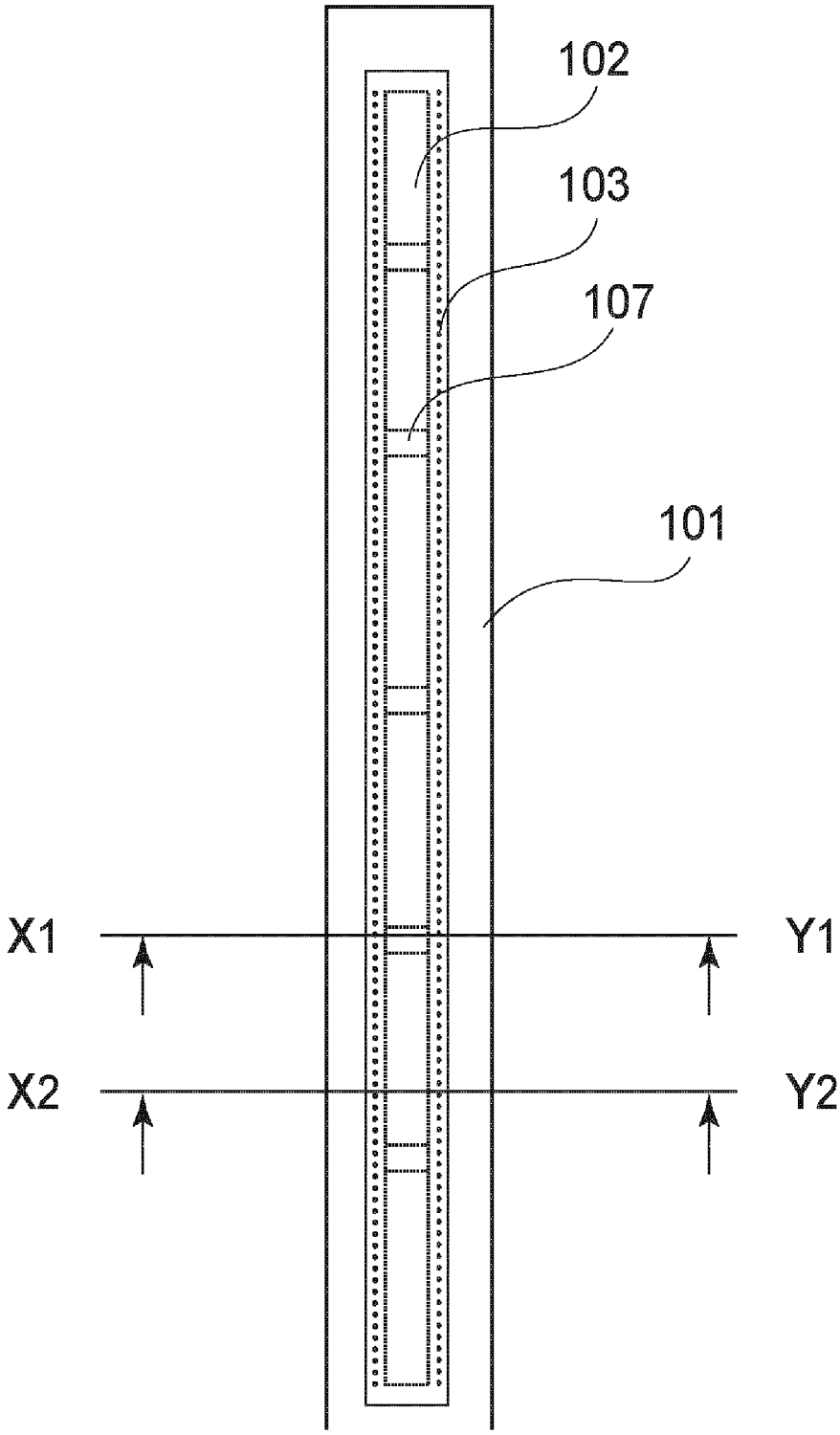
FIG. 1A is a schematic plan view of the ink jet head chip in one of the preferred embodiments of the present invention.
Figure 1B:
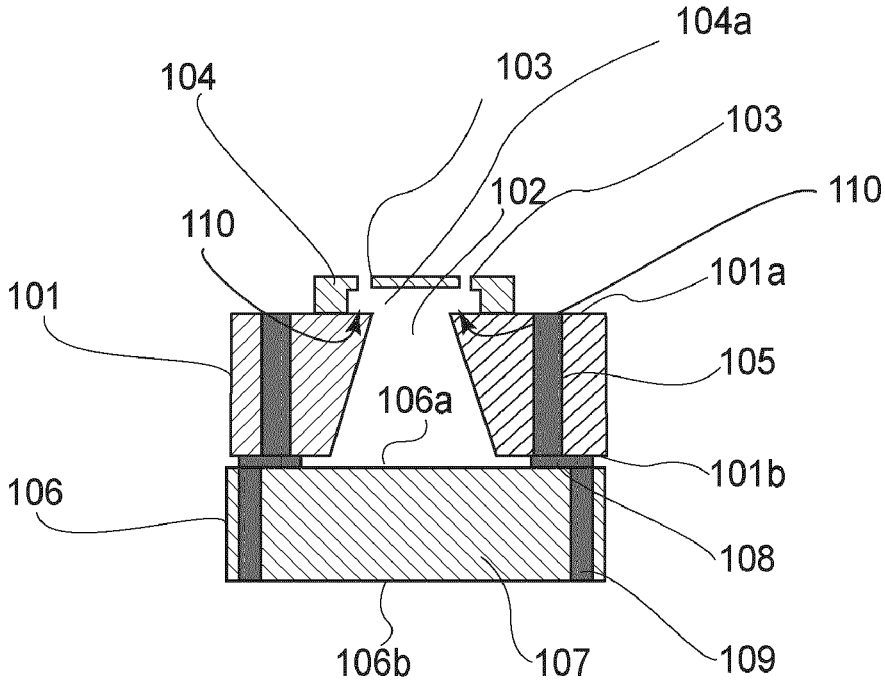
FIG. 1B is a schematic sectional view of the ink jet head chip shown in FIG. 1A, at a plane which coincides with Line X1-Y1 in FIG. 1A.
Figure 1C:
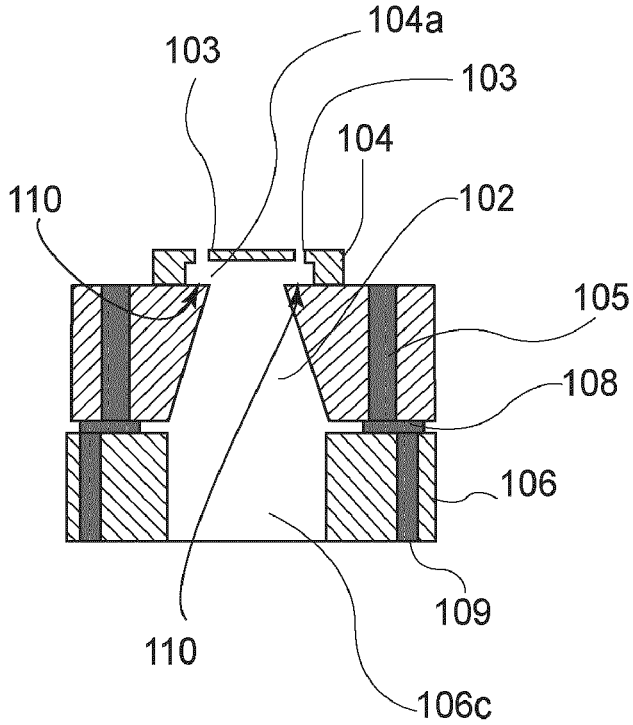
FIG. 1C is a schematic sectional view of the ink jet head chip shown in FIG. 1A, at a plane which coincides with Line X2-Y2 in FIG. 1A.

FIG. 1A is a schematic sectional view of the ink jet head chip in one of the preferred embodiment of the present invention. Incidentally, first through electrodes 105 are not shown in this drawing. FIG. 1B is a schematic sectional view of the ink jet head chip shown in FIG. 1A, at a plane which coincides with Line X1-Y1 in FIG. 1A. FIG. 1C is a schematic sectional view of the ink jet head chip shown in FIG. 1A, at a plane which coincides with Line X2-Y2 in FIG. 1A.

The ink jet head chip in this embodiment is made up of a substrate, an ink passage formation plate 104 formed on the substrate. It is also provided with a reinforcement plate 106, which is a substrate reinforcing member placed on the back surface of the substrate to prevent the common ink delivery channel 102, which is a through hole extending from the front surface of the substrate to the back surface of the substrate, etc., from deforming. Further, the ink jet head chip in this embodiment is provided with multiple through electrodes 105 (first through electrodes) put through the substrate, and multiple through electrodes 109 (second through electrodes) put though the reinforcement plate 106 to establish electrical connection between the first through electrode 105 and the external electrode(s) of the ink jet head chip.

In a case where a reinforcement plate having no second through electrode 109 is placed on the back surface of the substrate of the ink jet head chip 101, which has the first through electrodes 105, it is impossible to establish electrical connection between the first through electrodes 105 and external electrodes to extend electrical lead wires from the ink jet head chip. As for a solution to this problem, it is possible to directly attach the external lead wires to the first through electrodes 105, before placing the reinforcement plate having no through electrode, on the back surface of the substrate of the ink jet head chip 101. However, in order to do so, it must be after the dicing of a silicon wafer 100*a* that the reinforcement plate with no through electrode is placed on the back surface of the substrate of the ink jet head chip 101, making meaningless the reason for providing the ink jet head chip with the reinforcement plate.

Thus, in the case of the ink jet head chip manufacturing method in this embodiment, multiple first through electrodes 105 are formed through the silicon wafer 100*a*, and multiple reinforcement plates 106 are formed on a silicon wafer 100*b* so that the reinforcement plates 106 match in position the multiple ink jet head chips formed on the silicon wafer 100*a*. Then, the silicon wafer 100*b* is bonded to the back surface of the silicon wafer 100*a* so that not only the reinforcement plates 106 on the silicon wafer 100*b* match in position the precursors of the ink jet head chip on the silicon wafer 100*a*, one for one, but also, the first through electrodes 105 put through the substrates 101 silicon wafer 100*a*. The multiple reinforcement plates 106 on the silicon wafer 100*b* correspond to the multiple precursors of ink jet head chip 101 on the silicon wafer 100*a*, one for one. Each reinforcement plate 106 is provided with second through electrodes 109 put through the reinforcement plate 106 so that they can be placed in contact with the first through electrodes 105 put through the silicon substrate 100*a*, one for one. Further, the common ink delivery channels 102 are formed through the first silicon wafer 100*a* before the silicon wafer having the reinforcement plates 109 is bonded to the silicon wafer 100*a*. The multiple ink delivery holes 106*c* of the silicon wafer 100*b*, which correspond in position to the common ink delivery channels 102 of the silicon wafer 100*a*, are formed after the bonding of the silicon wafer 100*b* having the reinforcement plates 109, to the back surface of the silicon wafer 100*a*.

Next, the ink jet head chip in this embodiment will be described in detail.

First, multiple ink passage formation plate 104 are formed on the front surface 101*a* of the silicon wafer 100*a* (that is, front surface of substrate of ink jet head chip 101) so that each ink passage formation plate 104 has multiple ink ejection holes (openings) 103 and multiple ink passages 104*a* dedicated to the ink ejection holes one for one.

The silicon wafer 100*a* is etched so that the substrate of each precursor of the ink jet head chip 101 has the common ink delivery channel 102 for supplying the multiple dedicated ink delivery passages 104*a* with ink. Further, there are energy generating means for generating the energy for ejecting from ink ejection holes (openings) 103, on the front surface 101*a* of the substrate of each precursor of the ink jet head chip 101, being arranged so that they align one for one with the ink ejection holes 103 (openings). More specifically, the ink ejection energy generating means in this embodiment are heat generating resistors 110, which generate thermal energy as the ink ejection energy. Further, the substrate of the precursor of the ink jet head chip 101 (which hereafter may be referred to simply as ink jet head chip 101) is provided with first through electrodes 105 which extend from the front surface 101*a* of the substrate of the ink jet head chip 101 to the bottom surface 101*b* of the substrate of the ink jet head chip 101. The first through electrode 105 is the passage through which the electric power for causing the heat generating resistor 110 to generate heat is supplied.

The reinforcement plate 106 as the member for reinforcing the substrate of the ink jet head chip 101 is a plate for preventing the substrate of the ink jet head chip 101, which has the common ink delivery channels, from deforming. It is placed on the back surface 101*b* of the substrate of the ink jet head chip 101. The reinforcement plate 106 is provided with the ink delivery through hole 106*c*, which corresponds in position to the common ink delivery channel 102 of the substrate of the ink jet head chip 101. Further, the reinforcement plate 106 is provided with multiple ribs 107, which extend from one long lateral surface of the ink delivery hole 106*c* to the other. The ribs 107 are arranged in parallel in the ink delivery hole 106*c*, with the presence of preset intervals. The reinforcement plate 106 is also provided with second through electrodes 109, which extend from the front surface 106*a* of the reinforcement plate 106 to the back surface 106*b* of the reinforcement plate 106.

There are electrical wires 108 on the surface 106*a* of the reinforcement plate 106, which establish electrical connection between the first through electrodes 105 and second through electrode 109 by coming into contact therewith, as the silicon wafer 100*a* (substrate of ink jet head chip 101) and the silicon wafer 100*b* (substrate of reinforcement plate 106) are joined with each other. That is, the electrical connection between the first through electrodes 105 and second through electrodes 109 is established through the electrical wires 108.

Next, the method for manufacturing the ink jet head chip in this embodiment will be described.

First, the steps for manufacturing the ink jet head chip 101 will be described.

First, the silicon wafer 100*a*, which is 300 μm in thickness, is prepared. Then, a layer of TaN, which makes up the heat generating resistors, and a layer of Al, which makes up the electrodes, are formed on the silicon wafer 100*a* by sputtering. Then, the heat generating resistors 110 and electrodes are formed with the use of photolithography. The size of each heat generating resistor is 30 μm×30 μm. If necessary, each heat generating resistor may be covered with a protective layer. Next, multiple through holes, which are 50 μm in diameter, are cut through the silicon wafer 100*a* by dry etching so that they match in position to the precursors of the ink jet head chip 101, one for one. Then, the seed film for plating is formed on the surface of each through hole. Then, each through hole is filled with gold by electroplating to form the first through electrode 105. This completes the process of forming multiple precursors of the ink jet head chip 101 having the heat generating resistors 110 on the front surface of the substrate of the precursor, and the first through electrodes 105 which extend from the front surface of the substrate of the ink jet head chip 101 to the back surface of the substrate of the ink jet head chip 101. In other words, a substantial portion of the silicon wafer 100*a* is turned into multiple precursors of the ink jet head chip 101, which are arranged in a grid pattern.

Figure 2A:
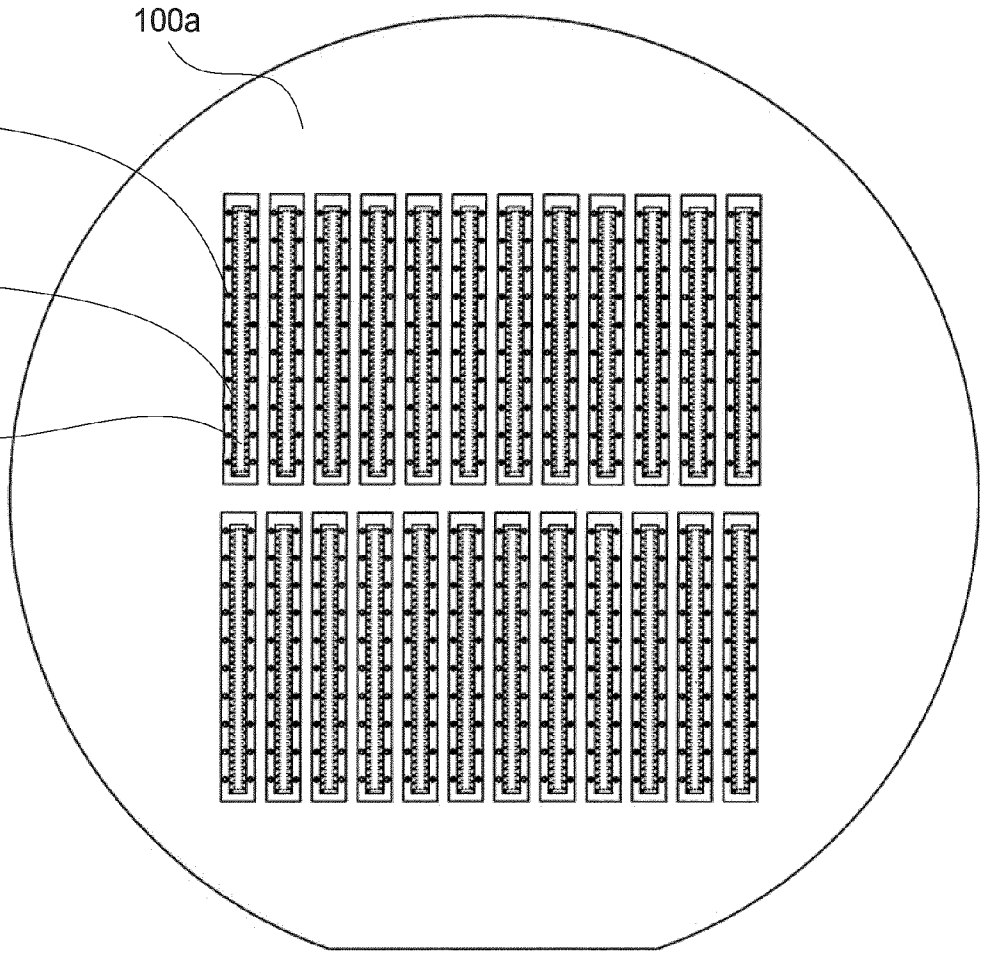
FIG. 2A is a schematic plan view of a silicon wafer on which multiple ink jet head chips have been formed in a grid pattern.
Figure 2B:
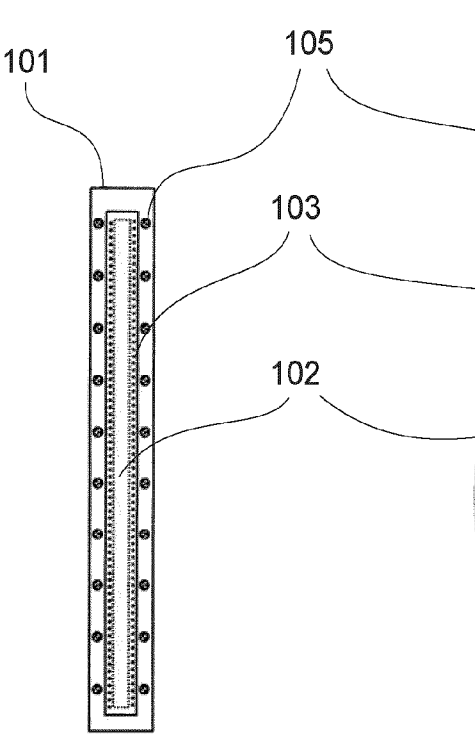
FIG. 2B is an enlarged schematic plan view of one of the ink jet head chips yielded by dicing the silicon wafer shown in FIG. 2A.

Next, a relatively thick film (15 μm thick) of positive resist, which is for forming the molds for the dedicated ink delivery passage 104*a*, which extend from the common ink delivery channel 102 to the ink ejection holes 103 (openings), is coated to a thickness of 15 μm on the front side (surface) of the silicon wafer 100*a* (surface 101*a* of substrate of ink jet head chip 101). Then, the molds having a preset pattern are formed by exposing the positive resist layer, and then, developing the positive resist layer. Then, photosensitive negative epoxy is applied to a thickness of 30 μm to cover the molds on the front side (surface) of the silicon wafer 100*a* (surface 101*a* of substrate of ink jet head chip 101). Thereafter, the layer of negative epoxy is exposed, and then, is developed to form the ink ejection holes 103 which are 25 μm in diameter. Then, the front side of the silicon wafer 100*a* is coated with protective resin, and then, the mask for forming the common ink delivery channels 102 by etching is formed on the back surface of the silicon wafer 100*a* (back surface 101*b* of substrate of ink jet head chip 101). Then, the silicon wafer 100*a* (precursor of ink jet head chip 101) is entirely dipped in liquid etchant which anisotropically etches the silicon wafer (substrate of ink jet head chip 101). As a result, each substrate of the ink jet head chip 101 is provided with the common ink delivery channel 102. Lastly, the resinous protective layer on the front side of the silicon wafer 100*a*, and the molds (patterned layer of positive resist) for forming the dedicated ink delivery passage 104*a*, are removed, yielding thereby the silicon wafer 100*a* having multiple ink jet head chips 101, each of which is made up of the ink ejection holes 103, dedicated ink delivery passages 104*a*, and heat generating resistors 101. After the completion of the above described steps, the silicon wafer 100*a* has multiple ink jet head chips 101, which are positioned in a grid pattern. FIG. 2A is a schematic plan view of the silicon wafer 100*a* having multiple ink jet head chips 101 which have been formed in a grid pattern, through the above described steps. FIG. 2B is an enlarged schematic plan view of one of the ink jet head chips 101 formed using the silicon wafer 100*a*.

Next, the steps for manufacturing the reinforcement plate 106 will be described.

Figure 3A:
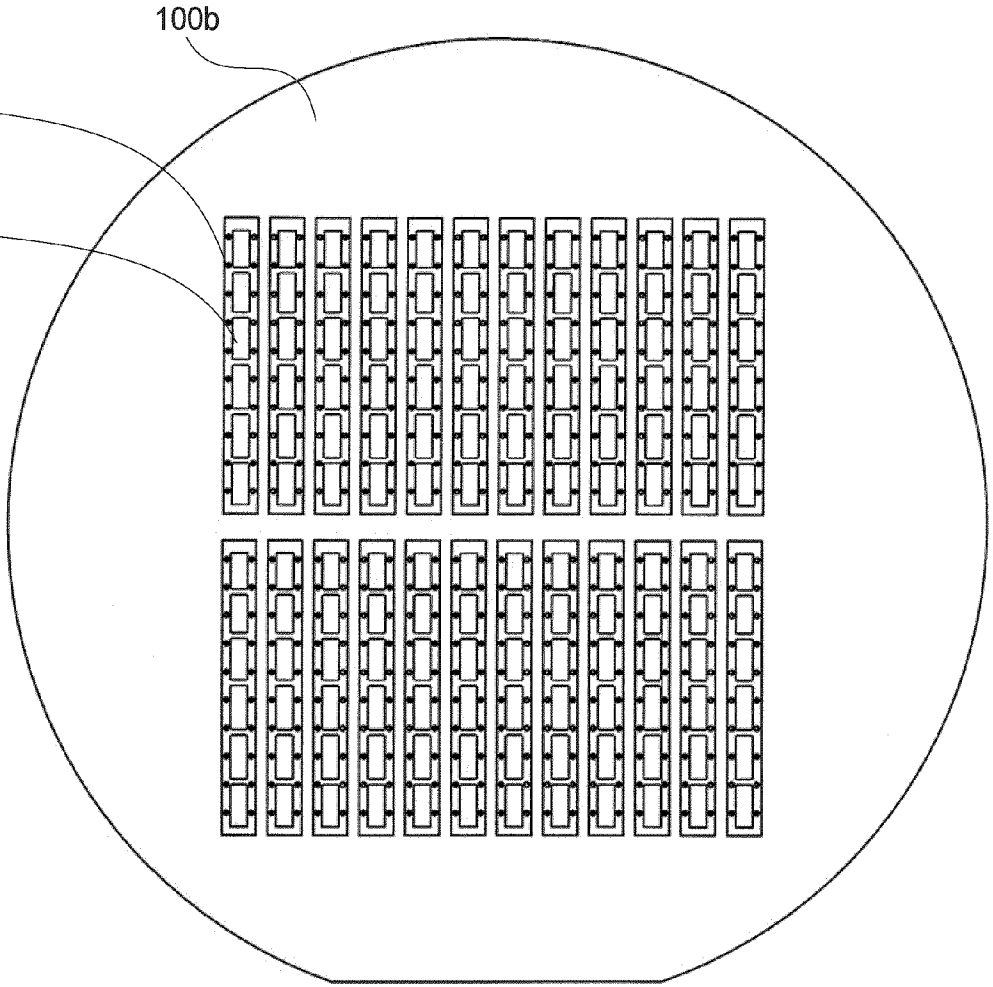
FIG. 3A is a schematic plan view of a silicon wafer on which multiple reinforcement plates have been formed in a grid pattern.
Figure 3B:
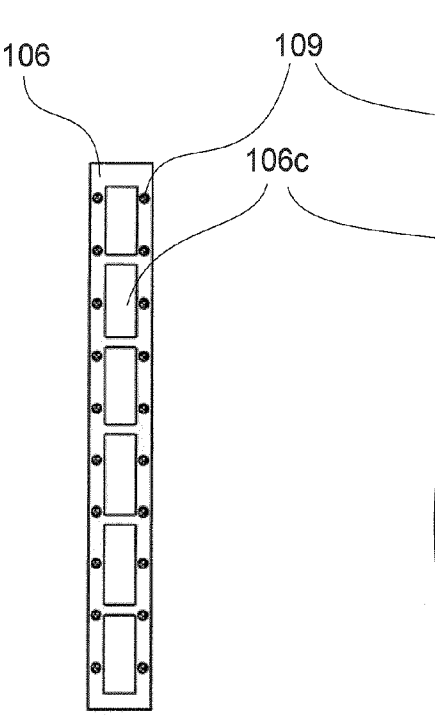
FIG. 3B is an enlarged schematic plan view of one of the reinforcement plates yielded by dicing the silicon wafer shown in FIG. 3A.

First, the silicon wafer 100*b*, which is 300 μm in thickness, is prepared. Then, multiple through holes, which are 50 μm in diameter, are cut through the silicon wafer 100*b* by dry etching. Next, a film of plating seed is formed on the surface of each through hole. Then, each through hole is filled with gold by electroplating, forming thereby second through electrode 109. Incidentally, wiring can be formed on the front and rear surfaces of the silicon substrate, during this step. Therefore, the wiring 108 is formed on the front surface of the silicon wafer 100*b* (which corresponds to front surface 106*a* of reinforcement plate 106), of gold by plating, during this step of forming the through electrodes 109. If necessary, wiring can be formed also on the back surface of the silicon wafer 100*b* (back surface 106*b* of reinforcement plate 106). Next, the through hole 106*c*, across which the ribs 107 extend, is formed by dry etching, yielding thereby the silicon wafer 100*b* having multiple reinforcement plates 106, each of which is made up of the wiring 108 and second through electrodes 109. FIG. 3A is a schematic plan view of the silicon wafer 100*b* after the multiple reinforcement plates 106 have been formed in a grid pattern on the silicon wafer 100*b*. FIG. 3B is an enlarged schematic plan view of one of the completed multiple reinforcement plates 106, which the silicon wafer 100*b* has.

After the completion of the above described steps, the ink jet head chips 101 are still parts of a pair of six inch (152.4 mm) silicon wafers, that is, the silicon wafers 100*a* and 100*b*.

Figure 4A:
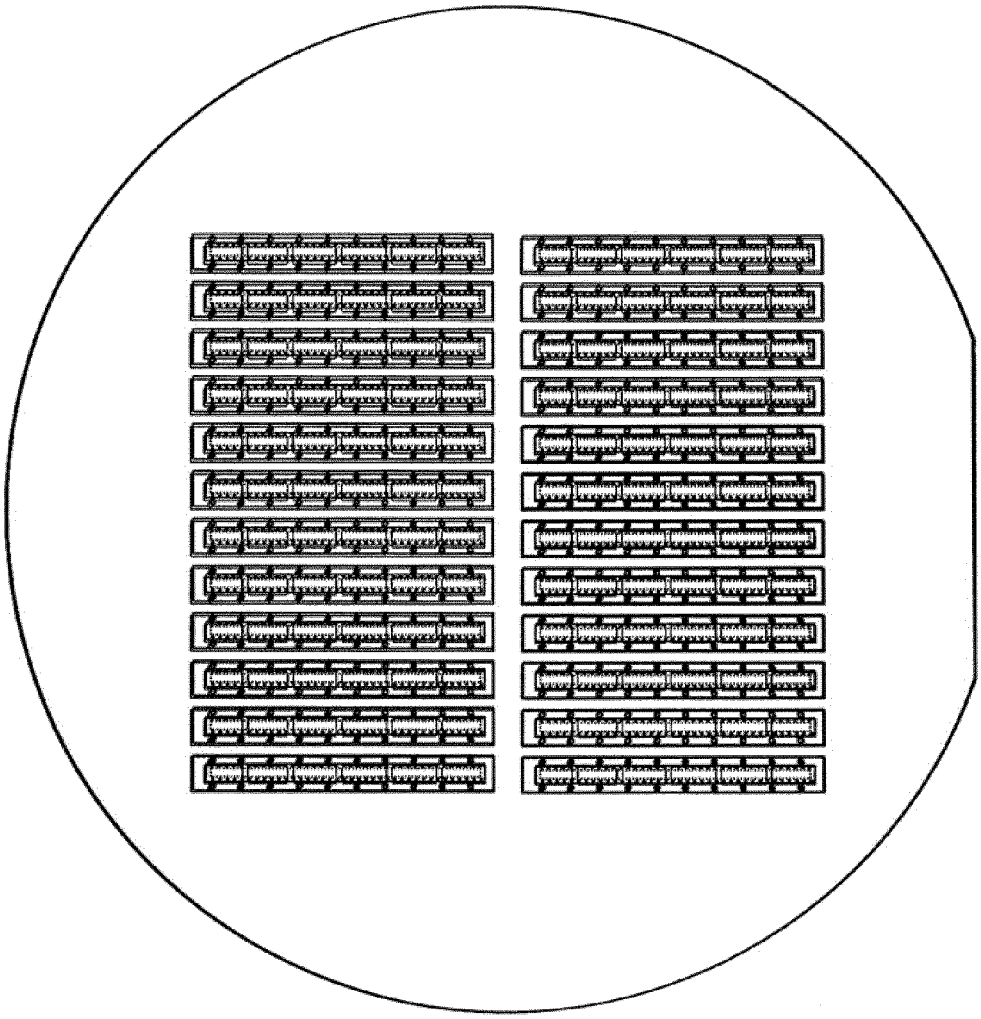
FIG. 4A is a schematic plan view of the front surface of a silicon wafer after multiple reinforcement plates were formed thereon in a grid pattern, and then, another silicon wafer on which multiple ink jet head chips had been formed in a grid pattern was bonded to the former so that the front surface of the latter faced the back surface of the former.
Figure 4B:
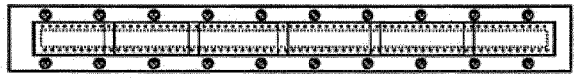
FIG. 4B is a schematic plan view of the back side of one of the ink jet head chips yielded by dicing the bonded combination of the two silicon wafers shown in FIG. 4A.

Then, the silicon wafers 100*a* and 100*b* are positioned relative to each other so that the back surface 101*b* of the substrate of each ink jet head chip 101 and the front surface 106*a* of the corresponding reinforcement plate 106 face each other and align with each other, and also, so that the common ink delivery channel 102 and first through electrodes 105 of each ink jet head chip 101, align with the through hole 106*c* and second through electrodes of the corresponding reinforcement plate 106, respectively. Then, the two wafers 100*a* and 100*b* are solidly bonded to each other so that the common ink delivery channel 102 is connected to the through hole 106*c*, and electrical connection is established between the first through electrodes 105 and second through electrodes 109, one for one. Then, the two wafers 100*a* and 100*b* are kept pressed upon each other in the ambience which is 200° C. in temperature, to ensure that the electrical connection is established between the first through electrode 105 of each ink jet head chip 101, which is formed of gold, and the wiring 108 of the corresponding reinforcement plate 106, which is also formed of gold. As a result, electrical connection is reliably established between each ink jet head chip 101 and corresponding reinforcement plate 106. In other words, electrical connection is established between the heat generating resistors 110 on the front surface 101*a* of the substrate of each ink jet head chip 101 and the second through electrode 109 of the corresponding reinforcement plate 106. FIG. 4A is a schematic plan view of the silicon wafer 100*b* after the silicon wafers 100*a* and 100*b* were bonded to each other so that the back surface of the silicon wafer 100*a* faces the front surface of the silicon wafer 100*b*. FIG. 4B is an enlarged schematic plan view of one of the ink jet head chip 101 to which the reinforcement plate 106 has been bonded.

Next, the bonded combination of the silicon wafers 100*a* and 100*b* is diced to yield multiple ink jet head chips 101 reinforced with the reinforcement plate 106. Then, each ink jet head chip 101 is sealed across its electrical junction and ink inlet, with sealant. Thereafter, the ink jet head chip 101 is put though the step for attaching an external wiring plate to the ink jet head chip 101, and step for bonding an ink delivery member to the ink jet head chip 101, to yield an ink jet recording cartridge.

As described above, in this embodiment, it is the reinforcement plate 106 that is provided with the second through electrodes 109. Therefore, the electrical connection between the ink jet head chip 101 and external electrical electrodes can be made on the rear surface 106*b* of the reinforcement plate 106. Also in this embodiment, the reinforcement plate 106 is bonded to the ink jet head chip 101 before the silicon wafer 100*a* holding multiple ink jet head chips 101 and the silicon wafer 100*b* holding multiple reinforcement plates 106 are diced. Therefore, the common ink delivery channel 102 is prevented from deforming, by the reinforcement plate 106, even after the dicing of the silicon wafers 100*a* and 100*b*. Therefore, it does not occur that the ink passage formation plate 104 peels away from the substrate of the ink jet head chip 101 and/or cracks. Further, providing the ink jet head chip 101 with the reinforcement plate 106 enables the ink jet head chip 101 to withstand the thermal stress which occurs during the step for attaching the external wiring plate to the ink jet head chip 101, and the step for bonding the ink delivery member to the ink jet head chip 101, preventing thereby the deformation of the common ink delivery channel 102. That is, in this embodiment, the problem that the common ink delivery channel 102 of the ink jet head chip 101 is deformed after the dicing of the silicon wafer on which multiple ink jet head chips 101 have been formed. Therefore, it is possible to deal with the previously mentioned problem that occurs as an ink jet head chip is increased in recording width to increase an ink jet recording apparatus in recording speed.

Further, in this embodiment, it is unnecessary to place external electrodes on the surface of the substrate of the ink jet head chip 101, which faces the front surface 106*a* of the reinforcement plate 106. That is, it is unnecessary to place electrical components on the front surface 101*a* of the substrate of the ink jet chip 101. Therefore, the ink jet head chip 101 in this embodiment can significantly reduce the gap between an ink jet head chip and a sheet of paper as recording medium. The reduction in the distance between an ink jet head chip and recording medium improves an ink jet recording apparatus in the accuracy with which each ink droplet jetted from the ink jet head chip lands on the recording medium, making it possible to improve an ink jet recording apparatus in image quality.

Figure 5A:
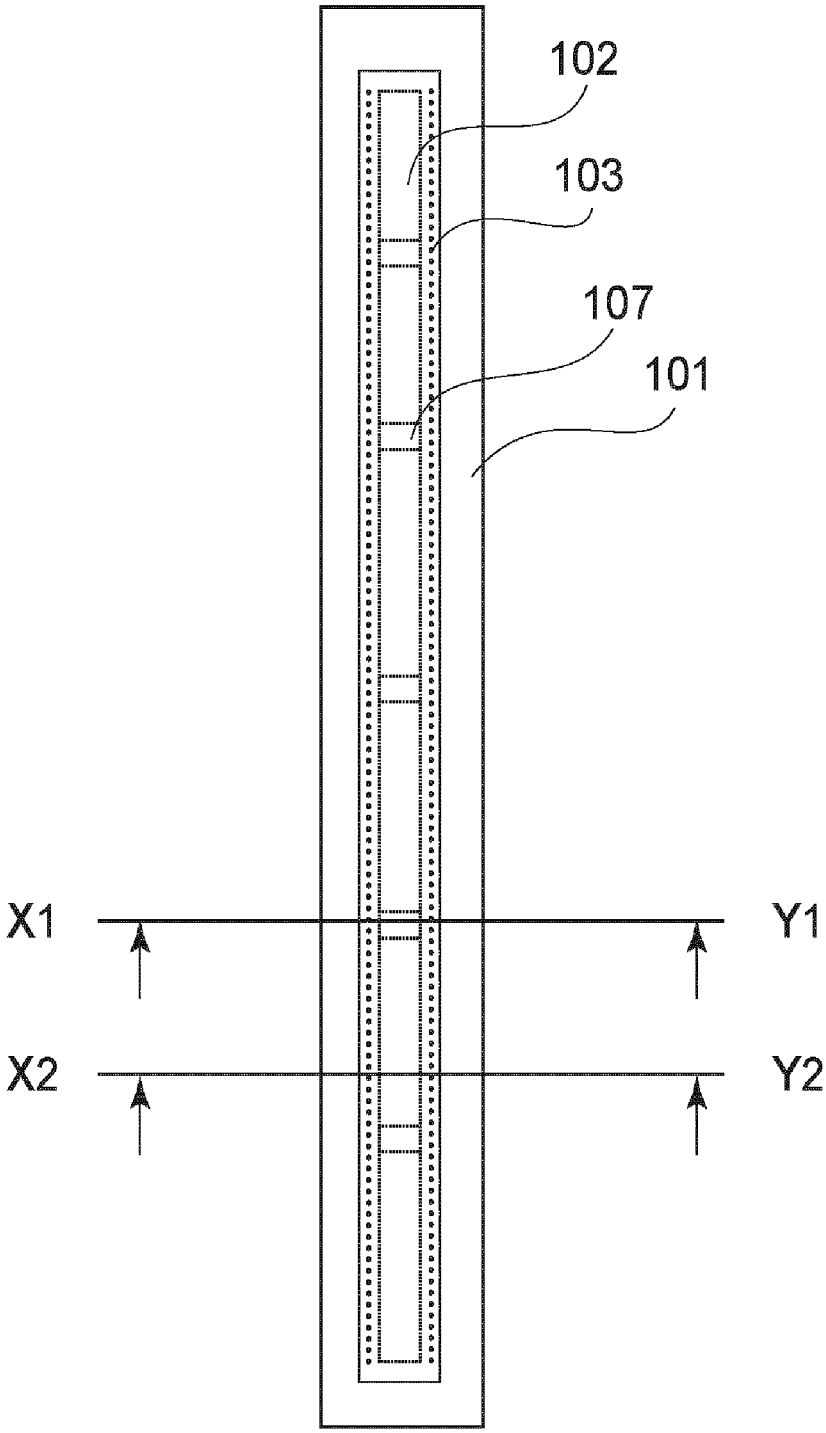
FIG. 5A is an enlarged schematic plan view of one of the modified versions of the ink jet head chip, in accordance with the present invention.
Figure 5B:
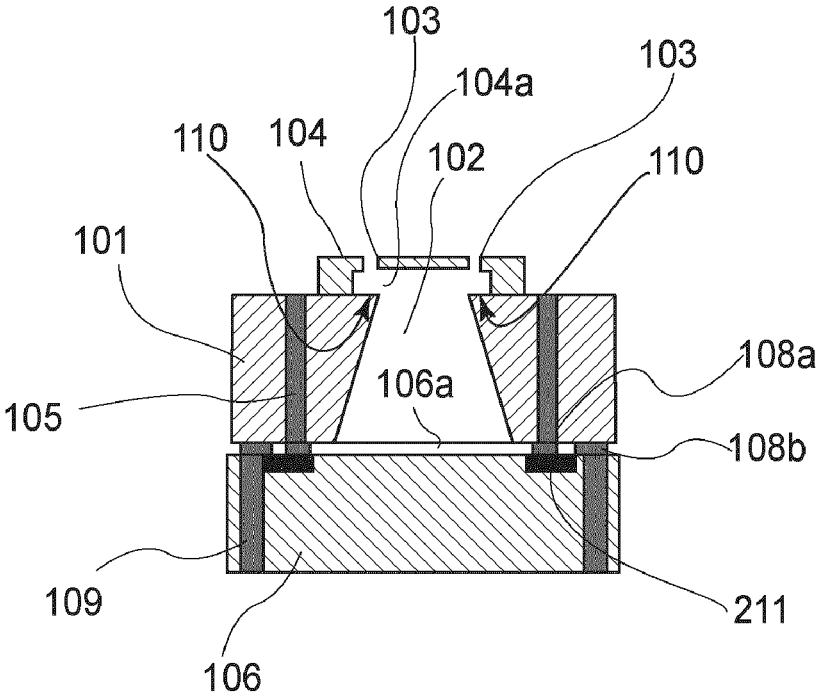
FIG. 5B is a schematic sectional view of the ink jet head chip shown in FIG. 5A, at a plane which coincides with Line X1-Y1 in FIG. 5A.
Figure 5C:
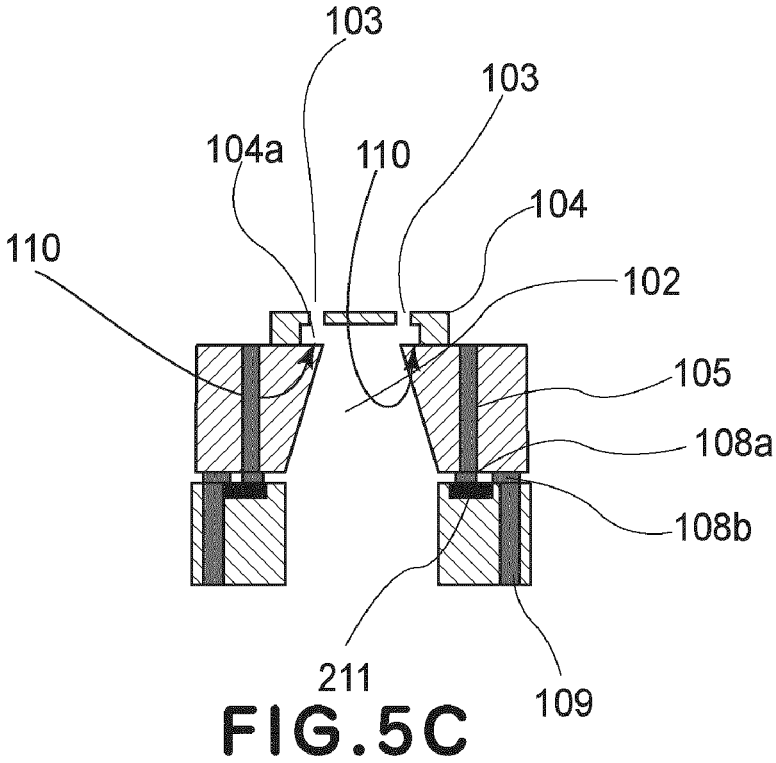
FIG. 5C is a schematic sectional view of the ink jet head chip shown in FIG. 5A, at a plane which coincides with Line X2-Y2 in FIG. 5A.
Figure 6A:
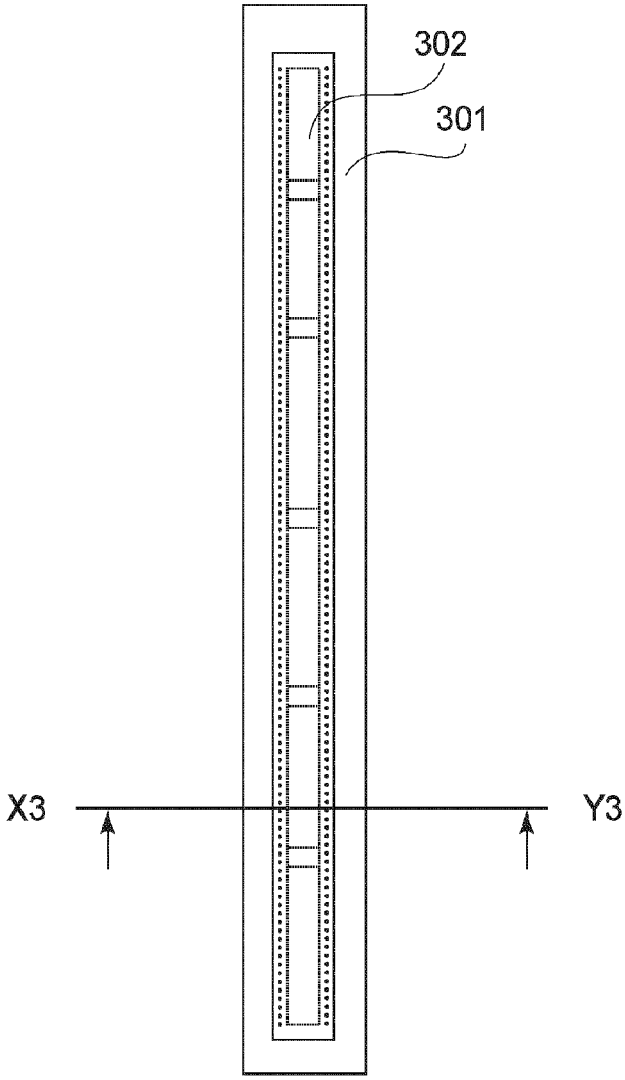
FIG.6A PRIOR ART
FIG. 6A is a schematic plan view of an example of ink jet head chip in accordance with the prior art.
Figure 6B:
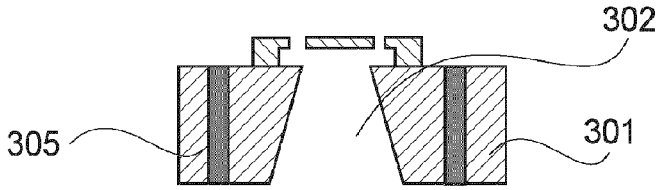
FIG.6B PRIOR ART
FIG. 6B is a schematic sectional view of the ink jet head chip shown in FIG. 6A, at a plane which coincides with Line X3-Y3 in FIG. 6A.

Incidentally, the reinforcement plate 106 of the ink jet head chip 101 in this embodiment is formed of silicon. Therefore, the ink jet head chip 101 in this embodiment can be modified so that the driving element 211 is placed on the reinforcement plate 106, as shown in FIG. 5. FIG. 5A is a schematic plan view of one of the modified versions of the ink jet head chip 101 in this embodiment. FIG. 5A does not show the second through electrodes 109. FIG. 5B is a schematic sectional view of the ink jet head chip shown in FIG. 5A, at a plane coinciding with Line X1-Y1 in FIG. 5A. FIG. 5C is a schematic sectional view of the ink jet head chip shown in FIG. 5A, at a plane which coincides with Line X2-Y2 in FIG. 5A.

The driving element 211 which drives the heat generating resistors 110, and the wirings 108*a* and 108*b*, are on the top surface 106*a* of the reinforcement plate 106. The driving element 211 is electrically connected to the first through electrodes 105 through the wiring 108*a*, and also, to the second through electrodes 109 through the wiring 108*b*. Placing the driving element 211 on the reinforcement plate 106 makes it unnecessary to place the driving element 211 on the substrate of the ink jet head chip 101, making it possible to reduce the ink jet head chip 101 in size and cost.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 337030/2006 and 288550/2007 filed Dec. 14, 2006 and Nov. 6, 2007 which are hereby incorporated by reference.

What is claimed is:

1. A liquid ejection head comprising:

a first substrate;

a rectangular liquid supply opening penetrating said first substrate;

a plurality of recording elements, provided along a longitudinal direction of said liquid supply opening on a front side of said first substrate, for generating energy for ejecting liquid;

a first penetrating electrode penetrating said first substrate from the front side to a back side thereof, for supplying electric power to said recording elements;

a plurality of ejection outlets, provided corresponding to said recording elements, respectively, for ejecting the liquid;

a flow path forming member for forming a flow path for fluid communication between said ejection outlets and said liquid supply opening;

a second substrate having a front side supporting said first substrate at the back side of said first substrate, wherein said second substrate is made of the same material as said first substrate and is connected with said first substrate;

a second penetrating electrode penetrating said second substrate from the front side to a back side thereof and electrically connecting with said first penetrating electrode;

a plurality of openings, penetrating said second substrate and extending in fluid communication with said liquid supply opening, for supplying the liquid to said liquid supply opening; and a conductive layer provided between the back side of said first substrate and the front side of said second substrate and in direct contact with said first penetrating electrode and with said second penetrating electrode, wherein said first penetrating electrode, said second penetrating electrode and said conductive layer are made of the same metallic material.

2. The liquid ejection head according to claim 1, wherein said openings are arranged along the longitudinal direction of said liquid supply opening.

3. The liquid ejection head according to claim 1, wherein said first penetrating electrode is provided by filling a first through hole with metal material, and said second penetrating electrode is provided by filling a second through hole with metal material.

4. The liquid ejection head according to claim 1, wherein said flow path forming member is provided on the front side of said first substrate.

* * * * *